US007899309B2

(12) United States Patent
Whyatt et al.

(10) Patent No.: US 7,899,309 B2
(45) Date of Patent: Mar. 1, 2011

(54) APPARATUS FOR VAPORIZATION OF LIQUID

(75) Inventors: Greg A. Whyatt, Richland, WA (US); Michael R. Powell, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 1051 days.

(21) Appl. No.: 11/674,975

(22) Filed: Feb. 14, 2007

(65) Prior Publication Data

US 2008/0193112 A1 Aug. 14, 2008

(51) Int. Cl.
*B01D 3/06* (2006.01)

(52) U.S. Cl. ..... 392/399; 392/386; 392/307; 392/397

(58) Field of Classification Search ..... None
See application file for complete search history.

(56) References Cited

U.S. PATENT DOCUMENTS

| | | | | |
|---|---|---|---|---|
| 3,566,615 | A * | 3/1971 | Roeder, Jr. | 62/511 |
| 3,584,194 | A * | 6/1971 | Kautz et al. | 392/484 |
| 3,854,032 | A * | 12/1974 | Cooper | 219/383 |
| 4,465,922 | A * | 8/1984 | Kolibas | 392/484 |
| 4,480,172 | A * | 10/1984 | Ciciliot et al. | 392/396 |
| 5,265,318 | A * | 11/1993 | Shero | 29/447 |
| 6,343,416 | B1 * | 2/2002 | Miller et al. | 29/890.035 |
| 7,756,404 | B2 * | 7/2010 | Schubert et al. | 392/478 |
| 2004/0124259 | A1 | 7/2004 | Guezennec et al. | |
| 2008/0089676 | A1 * | 4/2008 | Schubert et al. | 392/478 |

FOREIGN PATENT DOCUMENTS

WO 99/95452 2/1999

OTHER PUBLICATIONS

PCT International Search Report and Written Opinion.

* cited by examiner

*Primary Examiner*—Thor S Campbell
(74) *Attorney, Agent, or Firm*—Allan C. Tuan

(57) ABSTRACT

Apparatus for vaporizing liquid in a vaporization pathway having an actively controlled temperature are disclosed according to some aspects. The apparatus can comprise a first body having a cross sectional shape and dimensions substantially equal to the cross sectional shape and dimensions of a cavity in a second body, which allows the first body to be non-permanently inserted into the second body. The outer surface of the first body, the inner surface forming the cavity in the second body, or both can be modified to create a vaporization pathway between the first and second bodies when the surfaces mate and/or align. The liquid vaporizer can further comprise a vaporization pathway inlet for fluid comprising liquid, a vaporization pathway outlet for fluid comprising primarily vapor, and a heater in thermal communication with the first body, the second body, or both. The heater provides active control of the temperature of the vaporization pathway.

21 Claims, 4 Drawing Sheets

APPARATUS FOR VAPORIZATION OF LIQUID

BACKGROUND

Formation of deposits and clogging in flow channels can be challenges confronting almost any application involving vaporization of a liquid having a tendency to form solid deposits. One exemplary application is the vaporization of fuel oil such as might be performed prior to introducing the fuel into a combustion chamber. Vaporization of fuel oil is difficult because the temperature for complete vaporization is similar to the temperature at which breakdown of the fuel can occur. Introduction of an atomized spray into the combustion chamber, in which atomization can be achieved by using high fuel pressures or by atomization into compressed air, represents an exemplary alternative, but high pressure or compressed air systems are often undesirable due to the increased parasitic power cost, the equipment requirements, and/or the noise associated with providing the high fuel pressures or compressed air. In addition, atomization approaches are typically not suitable for applications where vaporization is needed such as applications where the fuel oil is not combusted. The problems associated with vaporization can become even more apparent when implemented in applications spanning wide operating ranges. Therefore, a need exists for apparatus capable of vaporizing liquids over wide operating ranges without forming deposits, clogging flow channels, or requiring high fuel line pressures or utilizing compressed air for atomization.

DESCRIPTION OF DRAWINGS

Embodiments of the invention are described below with reference to the following accompanying drawings.

DETAILED DESCRIPTION

At least some aspects of the present disclosure describe apparatus for vaporizing liquid in a vaporization pathway having an actively controlled temperature. In one embodiment, the liquid vaporizer comprises a first body having a cross sectional shape and dimensions substantially equal to the cross sectional shape and dimensions of a cavity in a second body, which allows the first body to be non-permanently inserted into the second body. The outer surface of the first body, the inner surface forming the cavity in the second body, or both can be modified to create a vaporization pathway between the first and second bodies when the surfaces mate and/or align. The liquid vaporizer can further comprise a vaporization pathway inlet for fluid comprising liquid, a vaporization pathway outlet for fluid comprising primarily vapor, and a heater in thermal communication with the first body, the second body, or both. The heater provides active control of the temperature of the vaporization pathway.

As used herein, the non-permanent insertion of the first body into the second body refers to the ability to non-destructively insert and separate the first body relative to the second body. The capability to separate the first and second bodies can, for example, facilitate cleaning and/or maintenance of the vaporization pathway and any assemblies or structures that may not be accessible but for removing the first body from the second body. The joining of the two bodies can form a substantially non-leaking union. Any variety of mechanisms can be used to secure the first body in the second body as necessary. Examples of fastening mechanisms can include, but are not limited to, screw threads, fastening tabs, compression fittings, friction fittings, locking jaws, locking studs, etc.

Modifications to the outer surface of the first body and/or the inner surface forming the cavity in the second body can result in a vaporization pathway comprising a channel formed along the outer surface of the first body, along the inner surface forming the cavity of the second body, or both, such that when the two bodies and/or surfaces mate, fluid can flow through the channel. In some embodiments, the channel is curved to increase the vaporization pathway length, which, in many instances, can increase the amount of time and/or distance for heat transfer.

In one embodiment, the temperature of the vaporization pathway is actively controlled through a heater providing electrical heat. Alternatively, the heater can comprise a heat exchanger. In various embodiments, the heater can be in thermal communication with the first body, the second body, and/or both to heat the vaporization pathway. Exemplary electrical heaters can include, but are not limited to, cartridge heaters, heating strips, and radiative heaters. Heat exchangers can utilize any variety of heat sources including, but not limited to, heat from a unit process upstream and/or downstream from the liquid vaporizer.

Figure 1A:
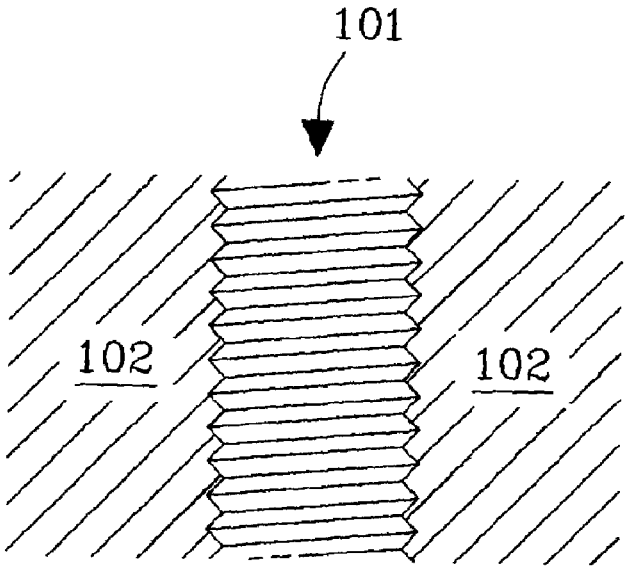
FIG. 1*a* is an illustration of the cross-section of an embodiment of a liquid vaporizer comprising threaded first and second bodies.
Figure 1B:
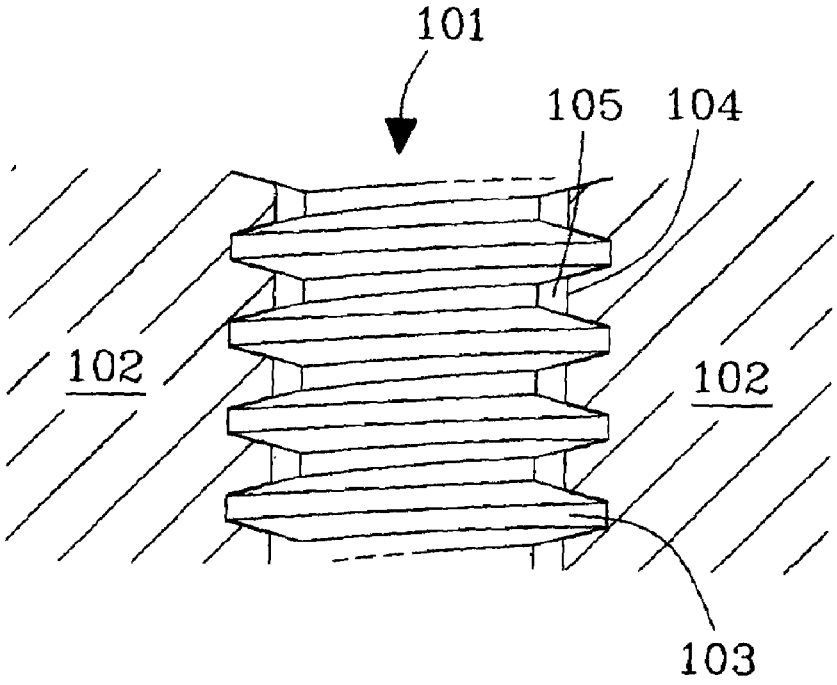
FIG. 1*b* is a detail view of the mated surfaces in one embodiment of a liquid vaporizer comprising threaded first and second bodies.

According to one particular embodiment, referring to FIGS. 1*a* and 1*b*, the first body 101 comprises a screw having screw threads 103. The inner surface forming the cavity in the second body 102 comprises cavity threads 104 corresponding to the screw threads. The vaporization pathway comprises a channel 105 formed from modifications to the screw threads, the cavity threads, or both. In the context of threads, exemplary modifications can include, but are not limited to, truncating, notching, and/or removing at least a portion of the ribs composing the screw threads, the ribs composing the cavity threads, or both. Accordingly, the first body 101 can be screwed into the second body 102 and the modified threads can provide a vaporization pathway for fluid flow. Referring to FIG. 1*b*, which is a detail view of the embodiment illustrated in FIG. 1 *a*, the tips of the cavity threads 104 have been bored (i.e., truncated) to a larger inside diameter such that when the screw threads 103 are mated, a channel 105 is formed between the bored cavity threads 104 and the screw threads 103.

Figure 2:
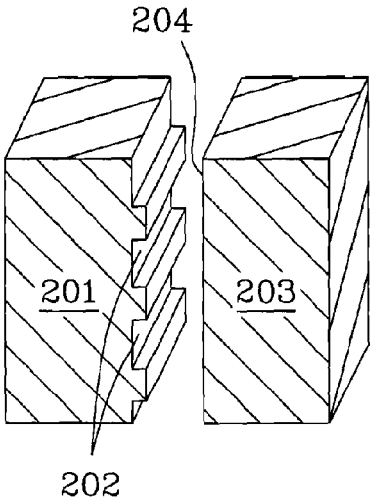
FIG. 2 is an illustration of the cross-section of an embodiment of a liquid vaporizer comprising non-threaded first and second bodies.

In alternative embodiments, the vaporization pathway can comprise one or more channels formed in the outer surface of the first body, the inner surface forming the cavity in the second body, or both. In such embodiments, there may or may not be protruding studs, ribs, or other structures from either of the bodies. In the context of such alternative embodiments, exemplary modifications, as used herein, can include, but are not limited to, etched, molded, grooved, notched, and textured surfaces. For example, referring to the embodiment illustrated in FIG. 2, an expanded, cross-sectional view of the interface between the first and second bodies shows that the vaporization pathway can comprise a channel 202 formed into the surface of the first body 201. The surface 204 of the cavity in the second body 203 can form a non-leaking seal when the first body is inserted into the second body and/or the surfaces mate.

Figure 3:
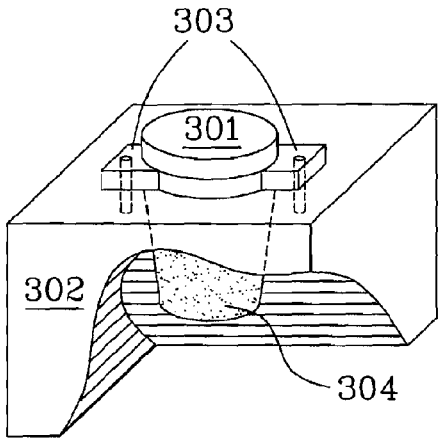
FIG. 3 is an illustration showing an embodiment of a liquid vaporizer comprising tapered first and second bodies having textured surfaces.
Figure 4:
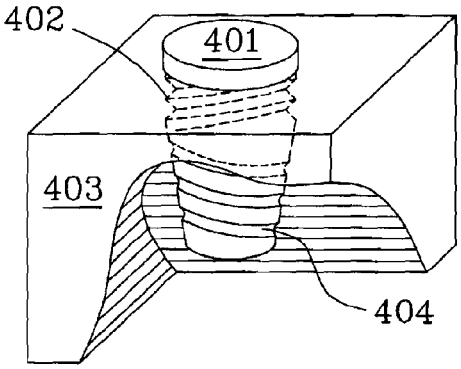
FIG. 4 is an illustration of an embodiment of a liquid vaporizer comprising tapered first and second bodies.

In instances where no protrusions exist, the first body can be secured into the second body using, for example, a friction fitting, wherein the shape and dimensions of the first body and the cavity in the second body are fabricated within small tolerances. Furthermore, the first body and the cavity in the second body can be conically tapered or substantially spherically shaped (e.g., a ball-and-socket). Further still, the surfaces of the first body and the cavity in the second body can be textured (e.g., ground) to facilitate the union between the two bodies. One example of a friction fitting, for purposes of comparison, is the union between ground glass fitting, although embodiments of the present invention are not limited to glass materials. Likewise, referring to the embodiment illustrated in FIG. 3, the mating surfaces 304 of the first body 301 and the second body 302 can be textured. Exemplary texturing can include, but is not limited to, a ground surface. As shown also in FIG. 3, retaining clips 303 can optionally be used to further secure the first body in the second body. Alternatively, referring to the embodiment illustrated in FIG. 4, relative to the depth of insertion of the first body 401 into the second body 403, a short segment of screw threads 402 can be used to secure the two bodies together, wherein the segment of screw threads can be separate from the vaporization pathway 404. Still other techniques exist for securing two bodies together, as described elsewhere herein and a might be known in the art, which techniques are encompassed by the scope of the present invention.

Figure 5:
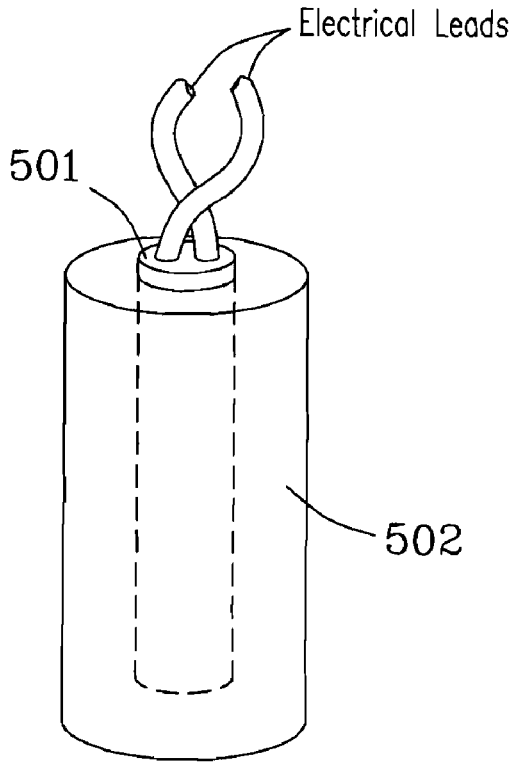
FIG. 5 is an illustration of an embodiment of a liquid vaporizer utilizing an electrical cartridge heater.
Figure 6:
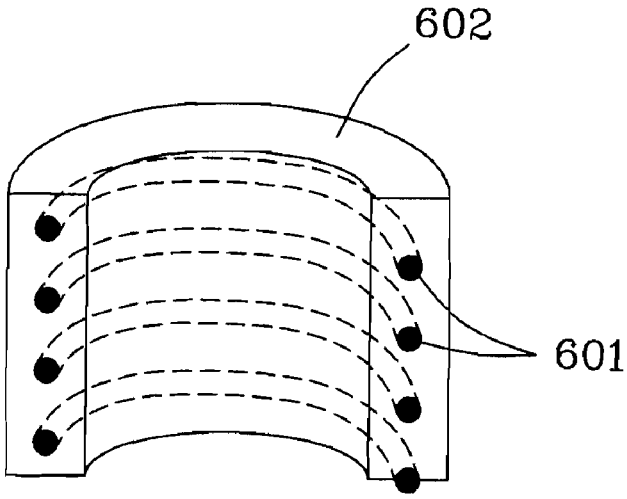
FIG. 6 is an illustration of the cross section of an embodiment of a liquid vaporizer utilizing a resistive element heater.

In the embodiments described herein, the heater controlling the temperature of the vaporization pathway can be embedded within the first body or within the second body. For example, referring to the embodiment illustrated in FIG. 5, an electrical cartridge heater 501 can be emplaced within a cavity in the first body 502. Alternatively, referring to the embodiment illustrated in FIG. 6, a resistive element 601 can be embedded within the second body 602. In another variation, the heater can simply surround the liquid vaporizer and/or the vaporization pathway. For example, heating strips and/or the path of a heat exchanger can wrap around the second body.

As noted elsewhere herein, liquid vaporizers capable of vaporizing liquids over wide operating ranges without forming deposits, clogging liquid lines, or utilizing high pressure feed lines can address challenges associated with a variety of applications that require liquid vaporization. Furthermore, the ability to access the vaporization pathway for cleaning and maintenance is advantageous in instances when fouling of the lines occurs in spite of prevention efforts and system design.

One example of an application that can benefit from the liquid vaporizers described elsewhere herein is a liquid fuel vaporizer and burner. Accordingly, one embodiment of the present invention encompasses a liquid fuel vaporizer and burner comprising a vaporization pathway and a heater providing active control of the temperature of the vaporization pathway independently from the operating rate of the liquid fuel burner. The liquid fuel burner further comprises a combustion chamber in fluid communication with the liquid fuel vaporization pathway outlet, wherein the liquid, which comprises a liquid fuel, is vaporized prior to introduction into a combustion chamber. In a preferred embodiment, the liquid fuel is substantially completely vaporized. While liquid fuel vaporizer and burners, as described herein, can be used with conceivable any liquid fuel, they can be particularly suited for burning fuel oils. Exemplary fuel oils can include, but are not limited to, JP8, diesel fuel, and other low-volatility fuels.

Some embodiments of the liquid fuel vaporizer and burner can comprise a vaporization pathway, as described elsewhere herein, that comprises a channel formed between two mated surfaces. The surfaces can be separated for cleaning, for maintenance, and for other unforeseen purposes. In a specific embodiment, the vaporization channel comprises a channel formed between the screw threads of a screw and the mating threads of a mated surface, wherein the screw threads, the mating threads, or both have been modified to provide the channel.

As described elsewhere herein, the temperature of the vaporization pathway can be actively controlled through a heater. In one embodiment, the combustion chamber is in thermal communication with the liquid vaporizer, and at least a portion of the heat for vaporization is transferred from the combustion chamber. Heat transfer from the combustion chamber can be conductive, convective, and/or radiative. The use of heat from the combustion chamber can reduce the heating load on the heater, however the heater would be substantially responsible for active control of the vaporization pathway temperature. Accordingly, in the instant embodiment, the rate of energy uptake from the combustion chamber should be less than that required for fuel vaporization over the range of burner operation.

Embodiments, wherein the heater comprises a heat exchanger, can utilize, at least in part, heat from the combustion chamber as a heat source in a controlled scheme. For example, a heat exchanger can utilize recirculated combustion gas in a controlled scheme from the combustion chamber.

In some embodiment, heat from the combustion chamber can also be used to preheat oxidant gas flowing to the combustion chamber, thereby improving the peak combustion temperature. For example, the oxidant gas can be flowed over at lease a portion of the exterior of the combustion chamber. Alternatively, a heat exchanger utilizing combustion gases as a heat source can be used to preheat the oxidant gas.

In other embodiment, a flow distribution insert providing flow distribution of oxidant gas flowing to the combustion chamber can be utilized. The insert can be located in a flow path of the oxidant gas upstream from the combustion chamber (i.e., as the oxidant gas flows to the combustion chamber). The flow distribution insert can be thermally conductive and can have a large surface area for enhanced heat transfer to the oxidant gases. An exemplary flow distribution insert can comprise a thermally conductive foam that is in thermal communication with the combustion chamber and the oxidant gas.

The design and the active temperature control of the vaporization pathway enables the embodiments of liquid fuel vaporizer and burners described herein to operate for long periods of time over a wide operating range with minimal deposit formation. Accordingly, in some embodiments, active control of the temperature of the vaporization pathway occurs over an operating range turndown ratio of up to at least 5 to 1, and preferable of up to at least 10 to 1. Furthermore, at least some of the embodiments of liquid fuel vaporizer and burners described herein can deliver heat at a substantially steady rate for at least 30 minutes. Should deposits form in spite of the design and/or the active temperature control, embodiments having separable bodies forming the vaporization pathway can expose the vaporization pathway for cleaning and maintenance.

EXAMPLE

Liquid Fuel Vaporizer and Combustor

Figure 7:
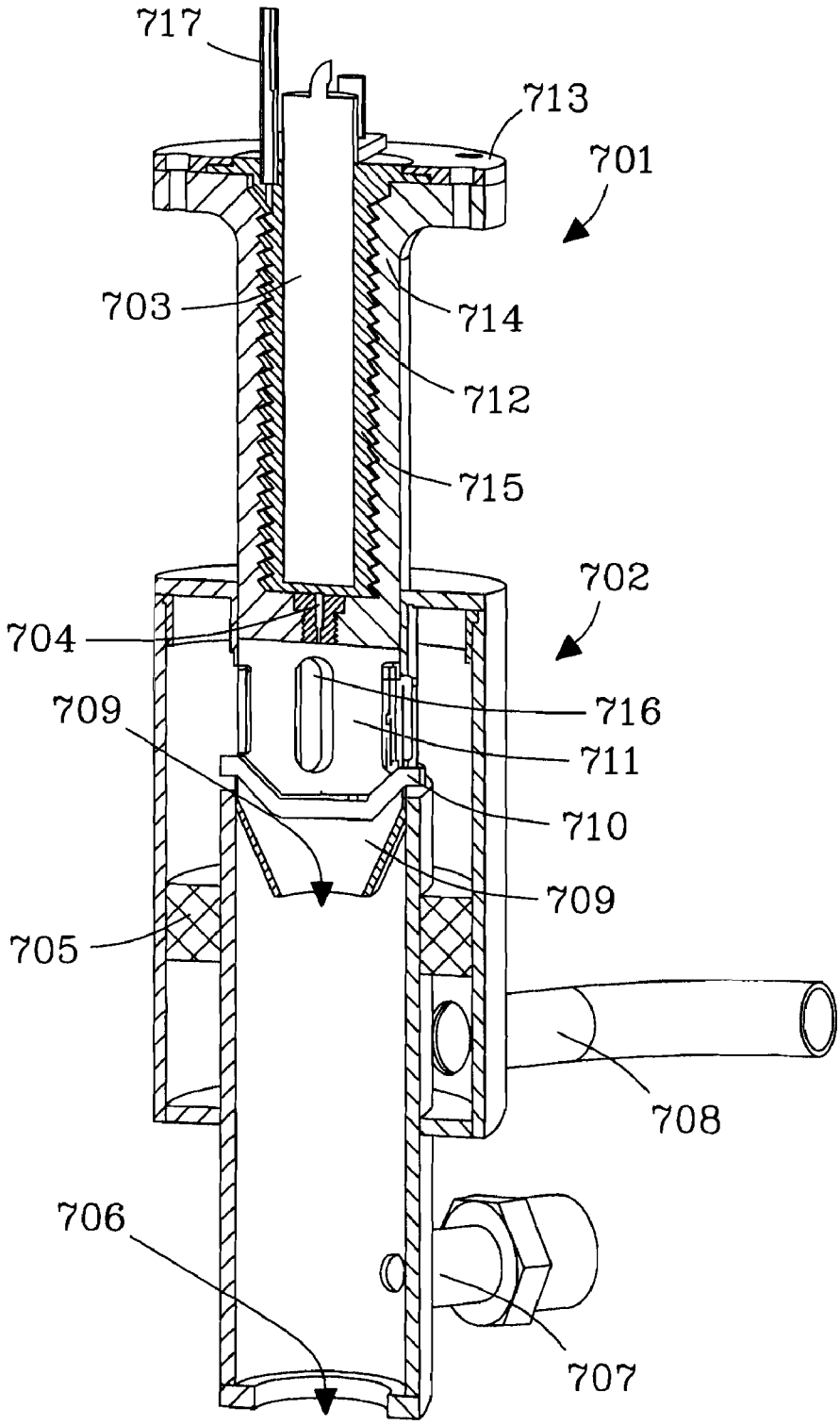
FIG. 7 is an illustration of an embodiment of a liquid fuel vaporizer and combustor.

Referring to FIG. 7, an embodiment of a liquid fuel vaporizer and burner is illustrated comprising a liquid fuel vaporizer 701 and combustor 702. In the instant embodiment, the vaporization pathway 712 comprises a channel formed between the truncated cavity threads of a second body 714 and the screw threads of a first body 715. A liquid fuel feed tube 717 feeds fuel to the vaporization pathway 712. Heat is added to the fuel via an electric heater cartridge 703 inserted into the first body 715. A temperature probe (not shown) can be place along the vaporization pathway, or elsewhere, to control the vaporization temperature. Vaporized fuel can exit through an outlet, which in the present embodiment comprises a nozzle 704 to jet the fuel into a burner cup 711. An optional retainer ring 713 can help to further secure the liquid vaporizer assembly and/or to seal the vaporization pathway thereby preventing fuel leakage out of the device from the vaporization pathway 712.

An impaction plate 710 in the burner cup 711 can prevent fuel from taking a direct pathway out of the burner cup. Oxidant gas enters the combustor 702 through an oxidant gas inlet 708 and is distributed substantially evenly around the perimeter of device. Distribution of the oxidant gas is aided by the pressure drop created by an oxidant gas flow distribution insert 705. In the present embodiment, the flow distribution insert comprises an annular ring of porous metal foam. The flow distribution insert, which receives heat from the combustion of the fuel, can also serve to preheat the oxidant gas flowing through. The oxidant gas then travels over the outside of the burning cup 711, which can further preheat the gas, and enters through louvered slots 716 in the burner cup. The louvers can induce swirl in the burner cup to improve fuel-air mixing and reduce radiation heat transfer out of the cup. The burner cup can be tapered to the outlet 709 to further reduce radiation heat losses out of the burner cup. An igniter port 707 can be located downstream from the burner cup to initially ignite the fuel. During exemplary operation, the burner can be started at low flow with a rich mixture that allows the flame to flash back from the igniter into the burner cup. Following ignition, the flows can be increased. Combustion gases are expelled through a combustion gas exit 706. In some embodiments, the heat from the combustion gas can be recycled by routing the combustion gas to a heat exchanger and/or to the liquid vaporizer region.

While a number of embodiments of the present invention have been shown and described, it will be apparent to those skilled in the art that many changes and modifications may be made without departing from the invention in its broader aspects. The appended claims, therefore, are intended to cover all such changes and modifications as they fall within the true spirit and scope of the invention.

We claim:

1. A liquid vaporizer and a combustion chamber, comprising:

a first body having a cross sectional shape and dimensions substantially equal to the cross sectional shape and dimensions of a cavity in a second body, thereby allowing the first body to be non-permanently inserted into the second body, wherein the outer surface of the first body, the inner surface forming the cavity in the second body, or both is modified to create a vaporization pathway between the first and second bodies when the surfaces mate;

a vaporization pathway inlet for fluid comprising a liquid fuel;

a vaporization pathway outlet for fluid comprising primarily vapor, the vaporization pathway outlet in fluid communication with the combustion chamber: and a heater in thermal communication with the first body, the second body, or both;

wherein the heater actively controls the temperature of the vaporization pathway, the liquid fuel is vaporized prior to introduction into the combustion chamber, the temperature of the vaporization pathway is actively controlled as a substantially independent operating parameter, and oxidant gas flowing to the combustion chamber is preheated by flowing over at least a portion of the exterior of the combustion chamber.

2. A liquid vaporizer and a combustion chamber, comprising:

a first body having a cross sectional shape and dimensions substantially equal to the cross sectional shape and dimensions of a cavity in a second body, thereby allowing the first body to be non-permanently inserted into the second body wherein the outer surface of the first body, the inner surface forming the cavity in the second body, or both is modified to create a vaporization pathway between the first and second bodies when the surfaces mate;

a vaporization pathway inlet for fluid comprising a liquid fuel;

a vaporization pathway outlet for fluid comprising primarily vapor, the vaporization pathway outlet in fluid communication with the combustion chamber;

a heater in thermal communication with the first body, the second body, or both, wherein the heater actively controls the temperature of the pathway, liquid fuel is vaporized prior to introduction into the combustion chamber, the temperature of the vaporization pathway is actively controlled as a substantially independent operating parameter; and a flow distribution insert providing flow distribution of oxidant gas flowing to the combustion chamber, wherein the insert is located in a flow path of the oxidant gas upstream from the combustion chamber.

3. The liquid vaporizer as recited in claim 2, wherein the flow distribution insert is thermally conductive and has a large surface area for enhanced heat transfer to the oxidant gases.

4. The liquid vaporizer as recited in claim 2, wherein the flow distribution insert comprises a thermally conductive foam.

5. A liquid fuel vaporizer and burner comprising a vaporization pathway and a heater providing active control of the temperature of the vaporization pathway independently from the operating rate of the liquid fuel burner, wherein liquid fuel is vaporized in the vaporization pathway prior to introduction into a combustion chamber, which combustion chamber is in fluid communication with the vaporization pathway, wherein active control of the temperature of the vaporization pathway occurs over an operating range turndown ratio of up to at least 5 to 1.

6. The liquid fuel vaporizer and burner as recited in claim 5, wherein active control of the temperature of the vaporization pathway occurs over an operating range turndown ratio of up to at least 10 to 1.

7. The liquid fuel vaporizer and burner as recited in claim 5, wherein the vaporization pathway comprises a channel formed between two mated surfaces.

8. The liquid fuel vaporizer and burner as recited in claim 7, wherein the two mated surfaces are separable.

9. The liquid fuel vaporizer and burner as recited in claim 7, wherein the vaporization pathway comprises a channel formed between the screw threads of a screw and the mating threads of a mated surface, wherein the screw threads, the mating threads, or both are modified to provide the channel.

10. The liquid fuel vaporizer and burner as recited in claim 5, wherein the heater comprises an electrical heater.

11. The liquid fuel vaporizer and burner as recited in claim 5, wherein combustion in the combustion chamber delivers heat at a substantially steady rate for durations greater than approximately 30 minutes.

12. The liquid fuel vaporizer and burner as recited in claim 5, wherein vaporized fuel is jetted through a removable orifice into the combustion chamber.

13. The liquid fuel vaporizer and burner as recited in claim 12, wherein the removable orifice is accessible through separation of the two mated surfaces.

14. The liquid fuel vaporizer and burner of claim 5, wherein the liquid fuel is substantially completely vaporized.

15. The liquid fuel vaporizer and burner of claim 5, wherein the combustion chamber is in thermal communication with the liquid vaporizer and at least a portion of the heat for vaporization is transferred from the combustion chamber.

16. The liquid fuel vaporizer and burner of claim 5, wherein the liquid comprises fuel oil.

17. The liquid fuel vaporizer and burner of claim 5, wherein the heater comprises a heat exchanger.

18. The liquid fuel vaporizer and burner as recited in claim 17, wherein the heat exchanger utilizes, at least in part, recirculated combustion gas in a controlled scheme from a combustion chamber, wherein the combustion chamber is in fluid communication with the liquid vaporizer.

19. The liquid fuel vaporizer and burner of claim 7, wherein the channel is curved to increase the vaporization pathway for heat transfer.

20. The liquid fuel vaporizer and burner of claim 9, wherein modifications to the threads comprise threads that have been truncated, notched, removed, or combinations thereof.

21. The liquid fuel vaporizer and burner as recited in claim 16, wherein the fuel oil is JP-8, diesel, or other low-volatility fuels.

* * * * *